US007988337B2

(12) United States Patent
Huang

(10) Patent No.: US 7,988,337 B2
(45) Date of Patent: Aug. 2, 2011

(54) LIGHT SOURCE ASSEMBLY

(75) Inventor: Shan-Fu Huang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 201 days.

(21) Appl. No.: 12/499,810

(22) Filed: Jul. 9, 2009

(65) Prior Publication Data

US 2010/0046218 A1 Feb. 25, 2010

(30) Foreign Application Priority Data

Aug. 21, 2008 (CN) ..... 2008 1 0304130

(51) Int. Cl.
*F21V 7/00* (2006.01)

(52) U.S. Cl. ..... 362/299; 362/311.02; 362/305; 362/307

(58) Field of Classification Search ..... 362/311, 362/1, 311.02, 311.06, 297–300, 307, 310
See application file for complete search history.

(56) References Cited

U.S. PATENT DOCUMENTS 4,215,390 A * 7/1980 Brandt ..... 362/311.04
5,230,560 A * 7/1993 Lyons ..... 362/297
5,335,157 A * 8/1994 Lyons ..... 362/297
6,070,994 A * 6/2000 Sebek et al. ..... 362/332
6,607,286 B2 * 8/2003 West et al. ..... 362/255
7,458,703 B2 * 12/2008 Han et al. ..... 362/267
7,470,045 B2 * 12/2008 Bansbach et al. ..... 362/327
7,726,837 B2 * 6/2010 Ewert ..... 362/249.02
7,726,848 B2 * 6/2010 Lai ..... 362/300
7,794,118 B2 * 9/2010 Huang et al. ..... 362/336
2005/0281034 A1 * 12/2005 Summerford et al. ..... 362/304

* cited by examiner

*Primary Examiner* — Ali Alavi
(74) *Attorney, Agent, or Firm* — Raymond J. Chew

(57) ABSTRACT

A light source assembly includes a light guide unit and a light emitting unit. The light guide unit includes a hollow enclosure and a lens unit enclosed in the enclosure. The enclosure has a top portion, a bottom portion and a sidewall connected between the bottom portion and the top portion. Protrusions extend from an outer surface of the sidewall and coil the sidewall. A light incident surface is positioned on the bottom portion. The lens unit extends from the bottom portion towards the top portion and has a inverted-frustoconical-shaped light guide portion. A inverted-conical-shaped groove is defined in a topmost portion of the light guide portion. A reflective surface is positioned on an inner wall of the groove. A refractive surface is positioned on an outer surface of the light guide portion and intersects the reflective surface. The light emitting unit is positioned adjacent to the light incident surface.

20 Claims, 7 Drawing Sheets

LIGHT SOURCE ASSEMBLY

BACKGROUND

1. Technical Field

The disclosure relates to a light source assembly.

2. Description of Related Art

Generally, light source assemblies can be categorized into side-light-type or direct-light-type based upon arrangement of light emitting units. The side-light-type light source assemblies have small volume, low energy consumption, and long lifespan, allowing them more suitable for being used in small-sized devices than the direct-light-type light source assemblies.

A typical side-light-type light source assembly includes a light emitting unit and a light guiding plate. The light emitting unit is arranged at a side of the light guiding plate. The light guiding plate directs light beams emitting from the light emitting unit to another side of the light guiding plate. However, the typical side-light-type light source assembly can only provide side-lights in one direction.

Therefore, a new light source assembly is desired to overcome the above-described shortcoming.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION OF THE EMBODIMENTS

Figure 1:
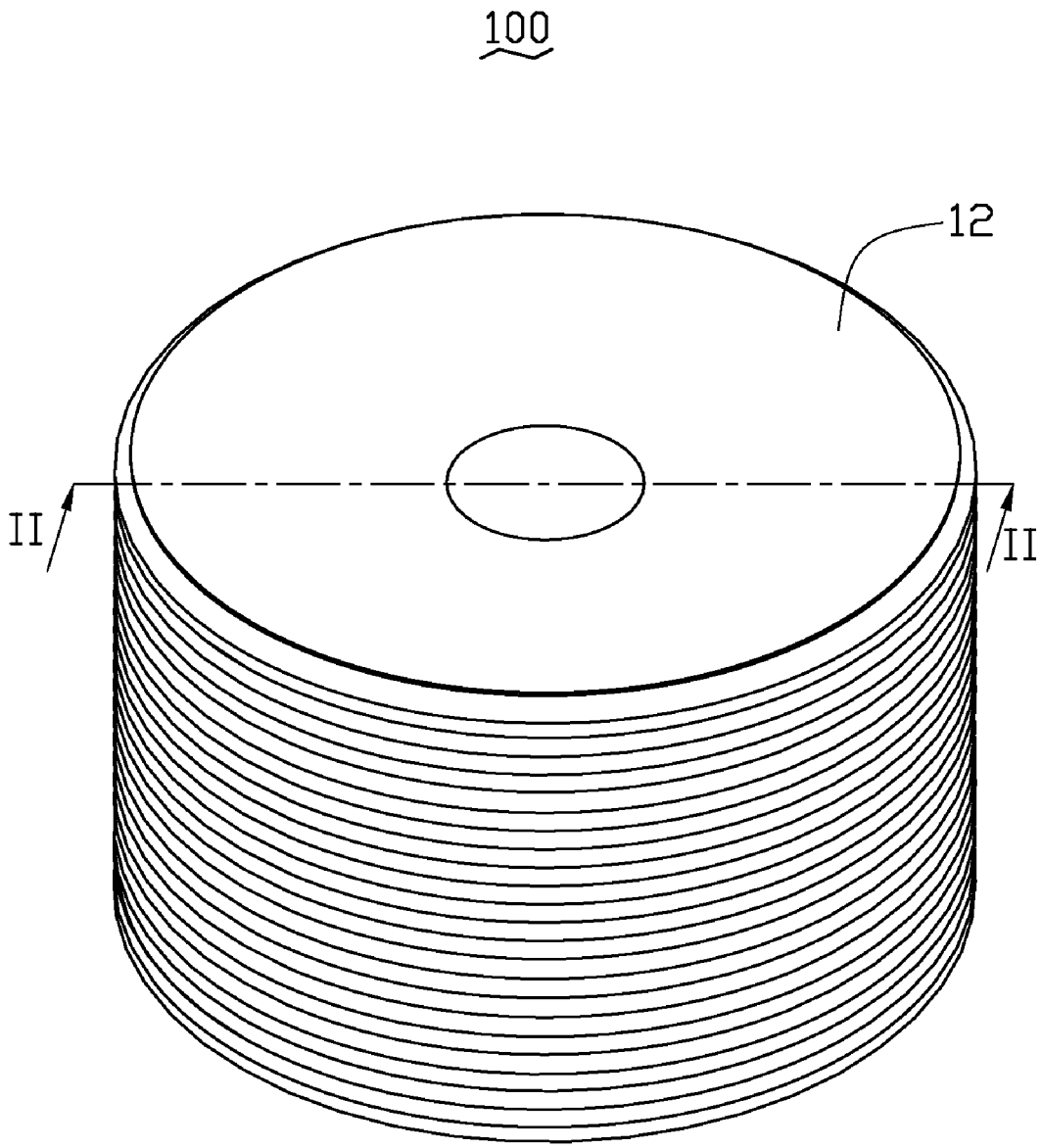
FIG. 1 is a perspective view of a first embodiment of a light source assembly.
Figure 2:
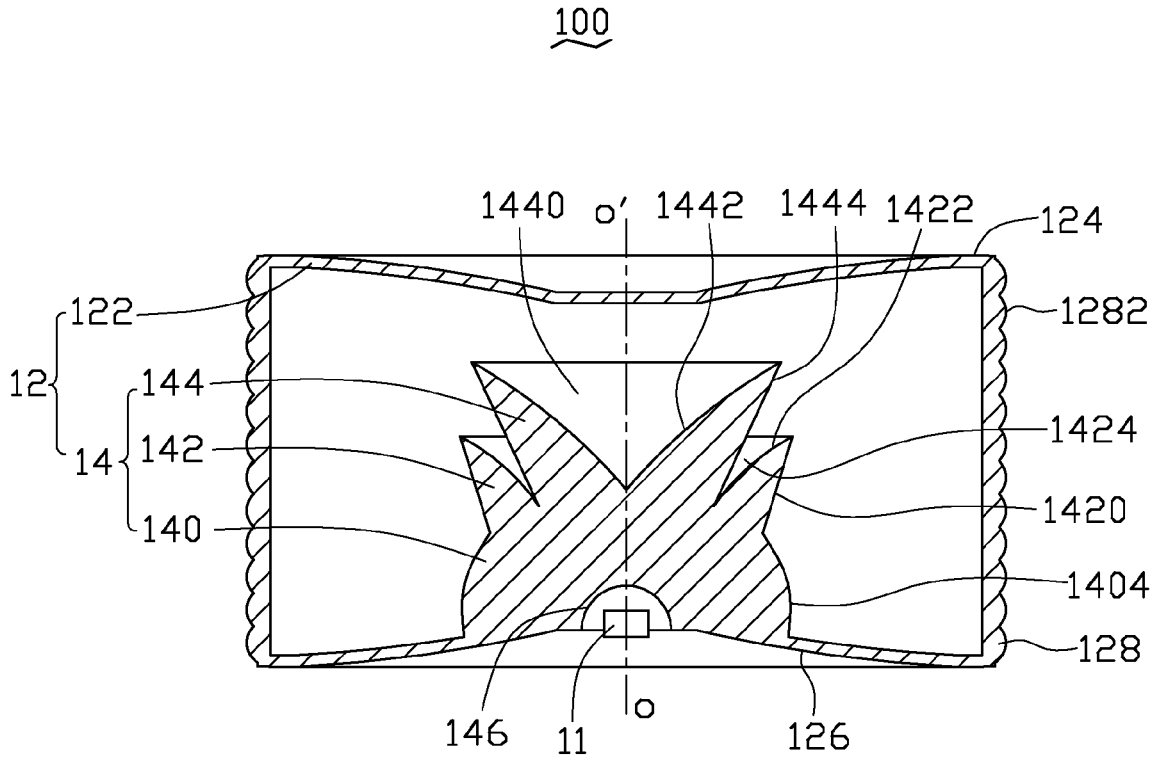
FIG. 2 is a cross-sectional view of the light source assembly of FIG. 1, taken along line II-II.

Referring to FIGS. 1 and 2, a first embodiment of a light source assembly 100 includes a first light emitting unit 11 and a light guide unit 12.

The light guide unit 12 includes a hollow enclosure 122 and a first lens unit 14 enclosed in the enclosure 122. The enclosure 122 and the first lens unit 14 are made of transparent materials having refractive index in a range from about 1.35 to about 1.7, such as polymethacrylate or polycarbonate.

The enclosure 122 is substantially cylindrical-shaped, and has a top portion 124, a bottom portion 126 and a sidewall 128. The sidewall 128 is connected between the bottom portion 126 and the top portion 124. A substantially semi-spherical-shaped first light incident surface 146 is formed in the bottom portion 126. A plurality of protrusions 1282 outwardly extends from an outer surface of the sidewall 128. The protrusions 1282 are parallel to each other and coil the sidewall 128. Each protrusion 1282 may have a substantially triangular-shaped or domical-shaped cross-section. In the illustrated embodiment, each protrusion 1282 has a domical-shaped cross-section.

The first lens unit 14 is substantially coaxial with the enclosure 12 at a central axis OO' of the enclosure 12. The first lens unit 14 extends from the bottom portion 126 towards the top portion 124. The first lens unit 14 has a first light guide portion 144, a second light guide portion 142 and a third light guide portion 140.

The first light guide portion 144 is substantially inverted-frustoconical-shaped. A substantially inverted-conical-shaped groove 1440 is defined in a topmost portion of the first light guide portion 144. A first reflective surface 1442 is positioned on an inner wall of the groove 1440. A first refractive surface 1444 is positioned on an outer surface of the first light guide portion 144 and intersects the first reflective surface 1442.

The second light guide portion 142 is substantially inverted-frustoconical-shaped. A substantially inverted-frustoconical-shaped recess 1424 is defined in a topmost portion of the second light guide portion 142. A second reflective surface 1422 is positioned on an inner wall of the recess 1424. A second refractive surface 1420 is positioned on an outer surface of the second light guide portion 142 and intersects the second reflective surface 1422. The first light guide portion 144 is partially received in the recess 1424, with the first refractive surface 1444 intersecting the second reflective surface 1422.

The third light guide portion 140 is substantially frusto-domical-shaped. A third refractive surface 1404 is positioned on an outer surface of the third light guide portion 140 and connected between the second refractive surface 1420 and the bottom portion 126.

The first light emitting unit 11 is positioned adjacent to the first light incident surface 146, and may include a light emitting diode.

Figure 3:
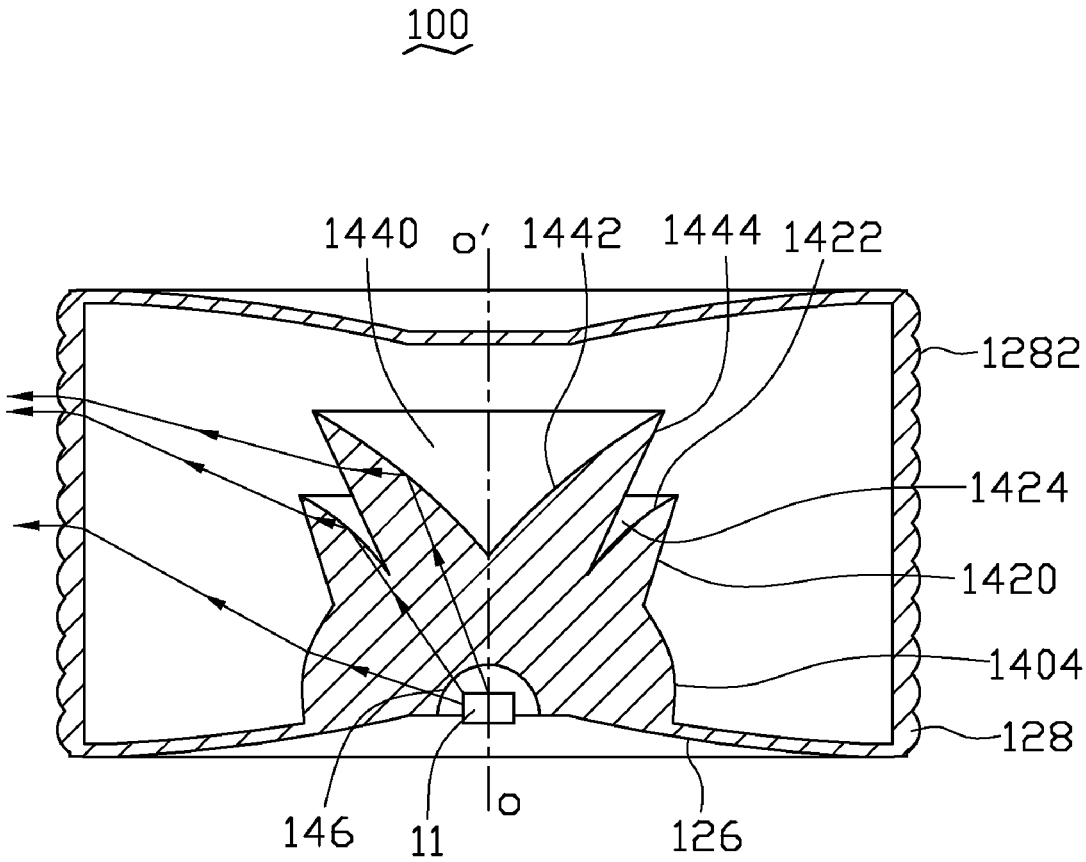
FIG. 3 is a cross-sectional view of the light source assembly of FIG. 1, in use.

Also referring to FIG. 3, in use, light beams emitted from the first light emitting unit 11 are transmitted into the first lens unit 14 through the first light incident surface 146. A portion of the light beams is transmitted to the first and second reflective surfaces 1442, 1422 and reflected by the first and second reflective surfaces 1442, 1422 to the first and second refractive surfaces 1444, 1420. Reflected light beams are then refracted again by the first and second refractive surfaces 1444, 1420 to the protrusions 1282. Another portion of the light beams is directly transmitted to the third refractive surface 1404 and refracted by the third refractive surface 1404 to the protrusions 1282. Finally, all refracted light beams emitted from the first lens unit 14 are redirected by the protrusions 1282 into parallel and even lights beams, and transmitted to the outside of the enclosure 122.

Figure 4:
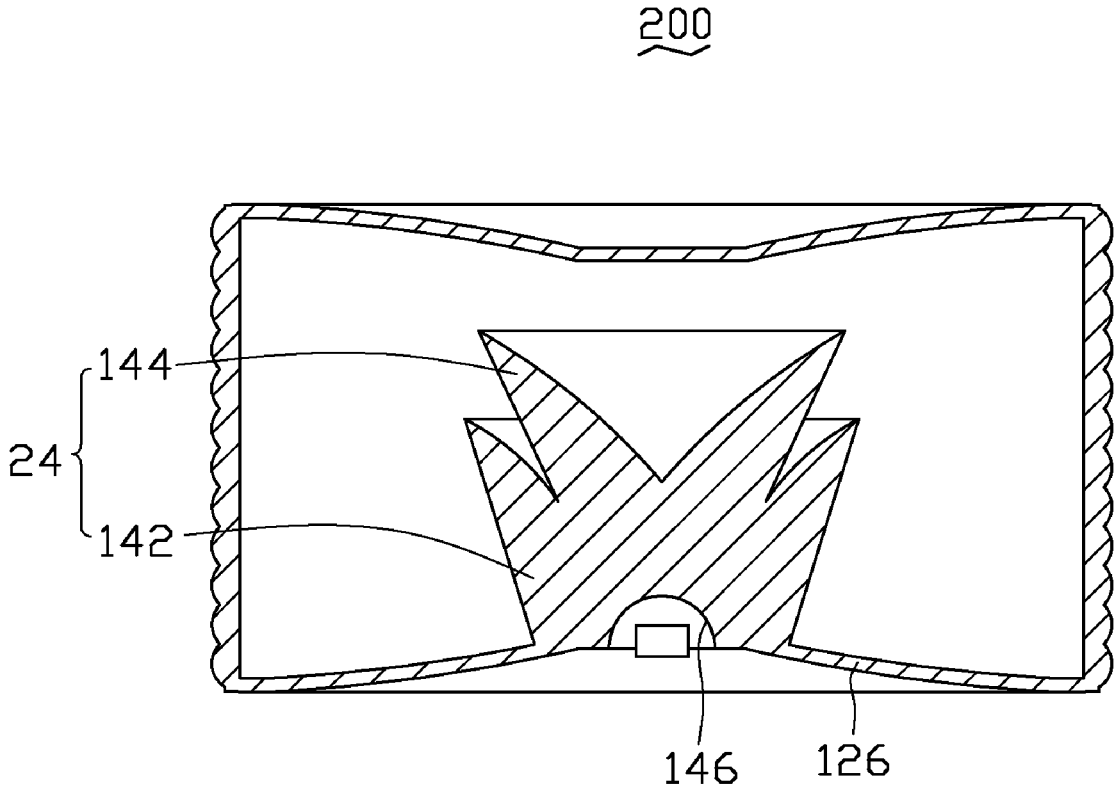
FIG. 4 is a cross-sectional view of a second embodiment of a light source assembly.

Referring to FIG. 4, a second embodiment of a light source assembly 200 is similar to the first embodiment of the light source assembly 100, except that the first lens unit 24 includes the first light guide portion 144 and the second light guide portion 142. The second light guide portion 142 is positioned on the bottom portion 126.

Figure 5:
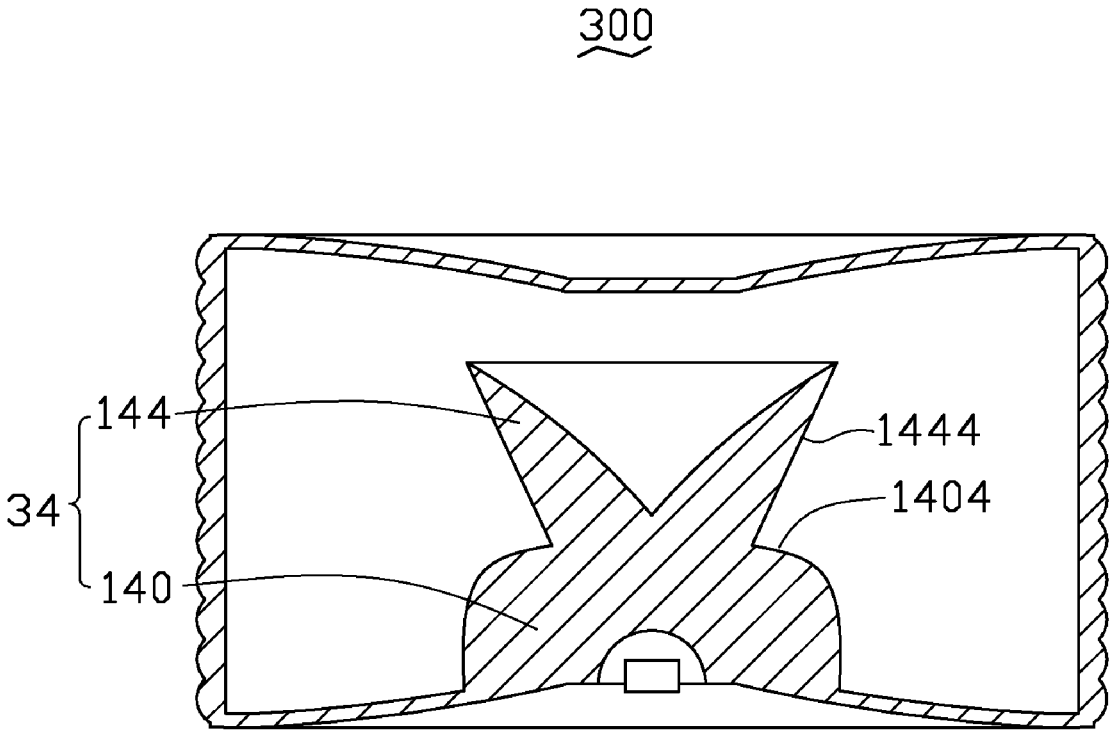
FIG. 5 is a cross-sectional view of a third embodiment of a light source assembly.

Referring to FIG. 5, a third embodiment of a light source assembly 300 is similar to the first embodiment of the light source assembly 100, except that the first lens unit 34 includes the first light guide portion 144 and the third light guide portion 140. The third refractive surface 1404 intersects the first refractive surface 1444.

Figure 6:
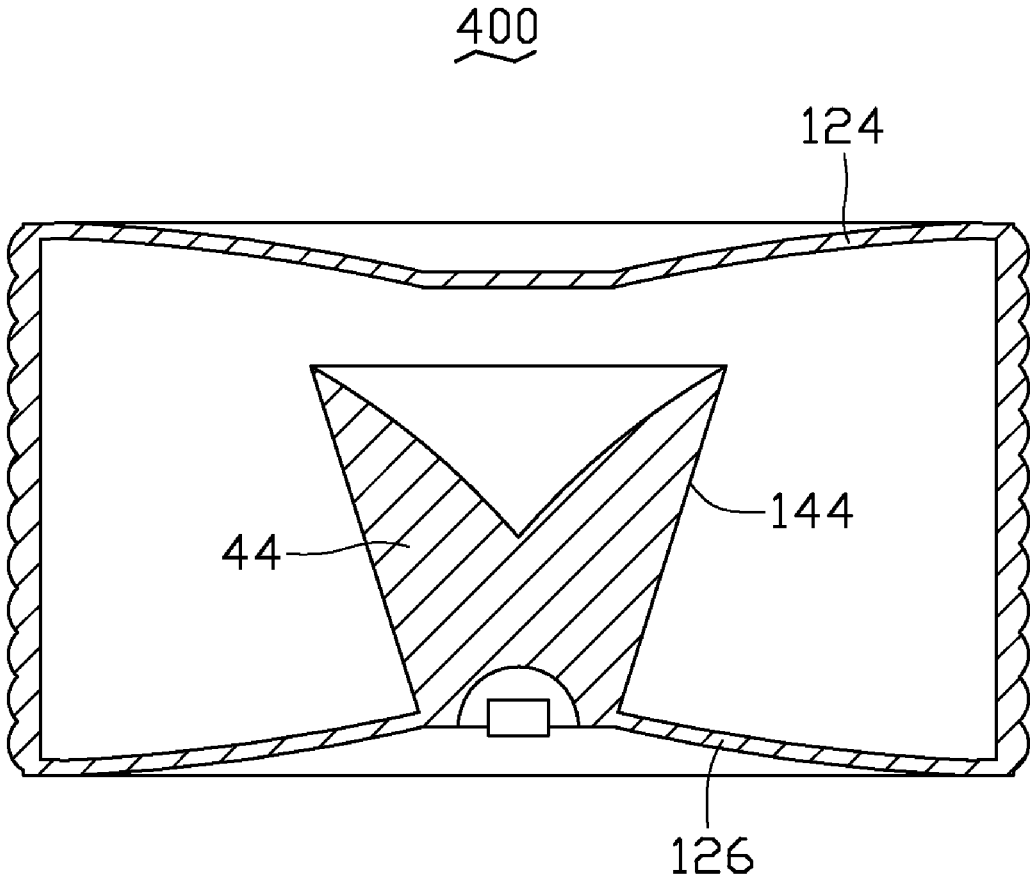
FIG. 6 is a cross-sectional view of a fourth embodiment of a light source assembly.

Referring to FIG. 6, a fourth embodiment of a light source assembly 400 is similar to the first embodiment of the light source assembly 100, except that the first lens unit 44 includes the first light guide portion 144. The first light guide portion 144 extends from the bottom portion 126 towards the top portion 124.

Figure 7:
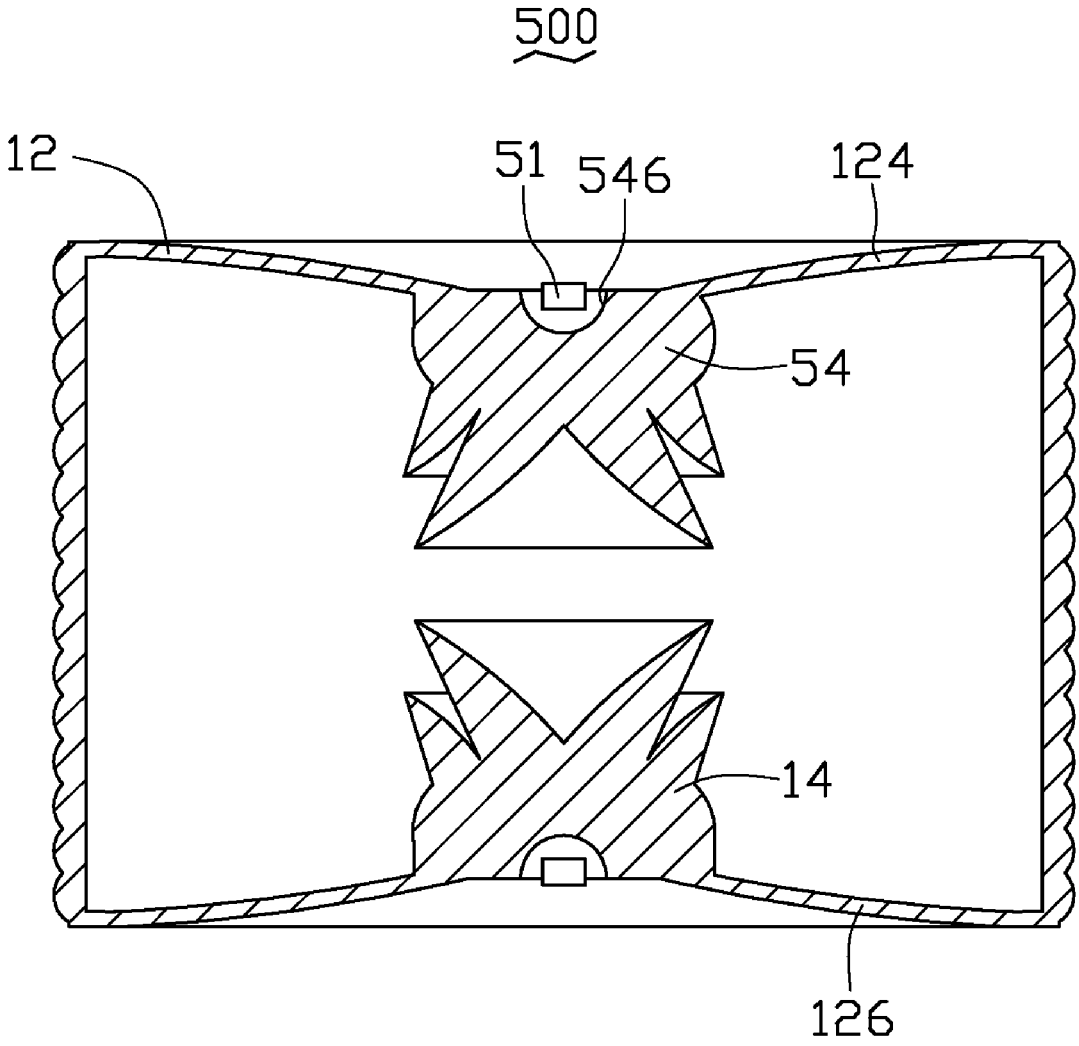
FIG. 7 is a cross-sectional view of a fifth embodiment of a light source assembly

Referring to FIG. 7, a fifth embodiment of a light source assembly 500 is similar to the first embodiment of the light source assembly 100, except that the light guide unit 12 further includes a second lens units 54. The second lens unit 54 is identical to the first lens unit 14 and extends from the top portion 124 towards the bottom portion 126. The first and second lens units 14, 54 are opposite to each other. A substantially semi-spherical-shaped second light incident surface 546 is formed in the top portion 124. A second light emitting unit 51 is positioned adjacent to the second light incident surface 546.

It is believed that the present embodiments and their advantages will be understood from the foregoing description, and it will be apparent that various changes may be made thereto without departing from the spirit and scope of the embodiments or sacrificing all of its material advantage.

What is claimed is:

1. A light source assembly, comprising:

a light guide unit, comprising:

a hollow enclosure having a top portion, a bottom portion and a sidewall connected between the bottom portion and the top portion, a plurality of protrusions extending from an outer surface of the sidewall and coiling the sidewall, and a first light incident surface being positioned on the bottom portion; and a first lens unit enclosed in the enclosure, extending from the bottom portion towards the top portion and having a substantially inverted-frustoconical-shaped first light guide portion, a substantially inverted-conical-shaped groove being defined in a topmost portion of the first light guide portion, a first reflective surface being positioned on an inner wall of the groove, and a first refractive surface being positioned on an outer surface of the first light guide portion and intersecting the first reflective surface; and a first light emitting unit positioned adjacent to the first light incident surface.

2. The light source assembly of claim 1, wherein the first lens comprises a substantially inverted-frustoconical-shaped second light guide portion, a substantially inverted-frusto-conical-shaped recess is defined in a topmost portion of the second light guide portion, a second reflective surface is positioned on an inner wall of the recess, a second refractive surface is positioned on an outer surface of the second light guide portion, and the second reflective surface is connected between the first and second refractive surfaces.

3. The light source assembly of claim 2, wherein the first lens comprises a frusto-domical-shaped third light guide portion, and a third refractive surface is positioned on an outer surface of the third light guide portion and connected between the second refractive surface and the bottom portion.

4. The light source assembly of claim 1, wherein the first light guide portion is positioned on the bottom portion.

5. The light source assembly of claim 2, wherein the second light guide portion is positioned on the bottom portion.

6. The light source assembly of claim 1, wherein the first lens unit comprises a frusto-domical-shaped third light guide portion, and a third refractive surface is positioned on an outer surface of the third light guide portion and connected between the first refractive surface and the bottom portion.

7. The light source assembly of claim 1, wherein the light guide unit comprises a second lens unit enclosed in the enclosure, the second lens unit is identical to the first lens unit and extends from the top portion towards the bottom portion, a second light incident surface is positioned on the top portion, and a second light emitting is positioned adjacent to the second light incident surface.

8. The light source assembly of claim 7, wherein the first and second light incident surfaces are substantially semi-spherical-shaped.

9. The light source assembly of claim 7, wherein each of the first and second light emitting units comprises a light emitting diode.

10. The light source assembly of claim 1, wherein the enclosure and the first lens unit are made of transparent materials having refractive index in a range from about 1.35 to about 1.7.

11. The light source assembly of claim 1, wherein the enclosure is substantially cylindrical-shaped.

12. The light source assembly of claim 1, wherein each of the protrusions has a substantially triangular-shaped or domical-shaped cross-section.

13. The light source assembly of claim 1, wherein the first lens unit is substantially coaxial with the enclosure at a central axis of the enclosure.

14. A light guide unit for a light source assembly, comprising:

a hollow enclosure having a top portion, a bottom portion and a sidewall connected between the bottom portion and the top portion, a first light incident surface being positioned on the bottom portion; and a first lens unit enclosed in the enclosure and extending from the bottom portion towards the top portion, the first lens unit comprising:

a substantially inverted-frustoconical-shaped first light guide portion, a substantially inverted-conical-shaped groove being defined in a topmost portion of the first light guide portion, a first reflective surface being positioned on an inner wall of the groove, and a first refractive surface being positioned on an outer surface of the first light guide portion and intersecting the first reflective surface; and a substantially inverted-frustoconical-shaped second light guide portion, a substantially inverted-frusto-conical-shaped recess being defined in a topmost portion of the second light guide portion, a second reflective surface being positioned on an inner wall of the recess, a second refractive surface being positioned on an outer surface of the second light guide portion, and the second reflective surface being connected between the first and second refractive surfaces.

15. The light guide unit of claim 14, wherein the first lens comprises a frusto-domical-shaped third light guide portion, and a third refractive surface is positioned on an outer surface of the third light guide portion and connected between the second refractive surface and the bottom portion.

16. The light guide unit of claim 14, wherein a plurality of protrusions extends from an outer surface of the sidewall and coils the sidewall.

17. The light guide unit of claim 16, wherein each of the protrusions has a substantially triangular-shaped or domical-shaped cross-section.

18. The light guide unit of claim 14, wherein the second light guide portion is positioned on the bottom portion.

19. The light guide unit of claim 14, further comprising a second lens unit enclosed in the enclosure, wherein the second lens unit is identical to the first lens unit and extends from the top portion towards the bottom portion, and a second light incident surface is positioned on the top portion.

20. The light guide unit of claim 19, wherein the first and second light incident surfaces are substantially semi-spherical-shaped.

* * * * *